US009301902B2

(12) United States Patent
Epars et al.

(10) Patent No.: US 9,301,902 B2
(45) Date of Patent: Apr. 5, 2016

(54) EXPANDABLE CONTAINER FOR PREPARATION OF A NUTRITIONAL COMPOSITION

(71) Applicant: NESTEC S.A., Vevey (CH)

(72) Inventors: Yann Epars, Penthalaz (CH); Alain Meier, Caneggio (CH)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 14/352,217

(22) PCT Filed: Oct. 10, 2012

(86) PCT No.: PCT/EP2012/070007

§ 371 (c)(1),
(2) Date: Apr. 16, 2014

(87) PCT Pub. No.: WO2013/057016

PCT Pub. Date: Apr. 25, 2013

(65) Prior Publication Data

US 2014/0246122 A1 Sep. 4, 2014

(30) Foreign Application Priority Data

Oct. 17, 2011 (EP) ..... 11185431

(51) Int. Cl.
*A61J 9/00* (2006.01)
*B65B 1/04* (2006.01)

(52) U.S. Cl.
CPC *A61J 9/008* (2013.01); *A61J 9/001* (2013.01); *A61J 9/005* (2013.01); *B65B 1/04* (2013.01)

(58) Field of Classification Search
CPC ..... A61J 9/00; A61J 9/005; B65B 1/04
USPC ..... 137/602; 215/6, 11, 11.1, 11.2, 11.3, 215/11.4, 11.5, 11.6; 141/100; 222/92, 93, 222/94, 95
See application file for complete search history.

(56) References Cited

U.S. PATENT DOCUMENTS 2,780,378 A * 2/1957 Romano ..... 215/11.1
3,143,429 A * 8/1964 Swanson et al. ..... 426/117

(Continued)

FOREIGN PATENT DOCUMENTS

EP 1437115 7/2004
EP 1437115 A1 * 7/2004

(Continued)

*Primary Examiner* — Timothy L Maust
*Assistant Examiner* — Andrew Schmid
(74) *Attorney, Agent, or Firm* — K&L Gates LLP

(57) ABSTRACT

The present invention relates to a container (1) for preparing of a nutritional composition from a powdered or concentrated liquid nutritional formula base, the container (1) comprising: —liquid inlet means (6) designed to be supplied with liquid from liquid dispensing means (20), —an adaptor (4) being provided with engagement means (2) for connecting the container (1) to matching engagement means (20*a*) of the liquid dispensing means (20), and —a flexible wall portion (31), connected to the liquid inlet means (6) and at least partially defining a compartment (3) for containing a predefined amount of powdered or concentrated liquid nutritional formula base (5) for the preparation of the nutritional composition (5*a*) upon hydration with the supplied liquid, wherein the flexible wall portion (31) is expandable in a manner that the volume of the compartment increases from a retracted position to an expanded position allowing a sufficient volume of liquid to be supplied into the compartment (3) through said liquid inlet means (6) for the preparation of the nutritional composition.

16 Claims, 9 Drawing Sheets

(56) References Cited

U.S. PATENT DOCUMENTS

| | | | | |
|---|---|---|---|---|
| 3,724,497 | A * | 4/1973 | Federer et al. | 137/575 |
| 3,779,413 | A * | 12/1973 | Pickerell et al. | 215/11.6 |
| 5,067,622 | A * | 11/1991 | Garver et al. | 215/381 |
| 5,553,745 | A * | 9/1996 | McMillian | 222/92 |
| 5,615,791 | A * | 4/1997 | Vatelot et al. | 215/382 |
| 5,667,101 | A * | 9/1997 | Barrash et al. | 222/92 |
| 5,921,233 | A * | 7/1999 | Gold et al. | 128/200.22 |
| 6,763,973 | B1 * | 7/2004 | Hudkins | 222/1 |
| 7,475,633 | B2 * | 1/2009 | Weinberg | 100/289 |
| 7,819,263 | B1 * | 10/2010 | DiCarlo-Nelson | 215/11.3 |
| 8,459,450 | B1 * | 6/2013 | Whitaker et al. | 206/219 |
| 2004/0045841 | A1 * | 3/2004 | Segovia et al. | 206/219 |
| 2004/0267228 | A1 * | 12/2004 | Hattori et al. | 604/406 |
| 2006/0226109 | A1 * | 10/2006 | Ellegaard et al. | 215/11.3 |
| 2007/0262041 | A1 * | 11/2007 | Smith | 215/11.5 |
| 2009/0178940 | A1 * | 7/2009 | Said | 206/221 |
| 2009/0301905 | A1 * | 12/2009 | Bullard et al. | 206/221 |
| 2009/0314735 | A1 * | 12/2009 | Vaserman | 215/11.4 |
| 2011/0233118 | A1 * | 9/2011 | Nelson | 210/117 |
| 2011/0233119 | A1 * | 9/2011 | Nelson | 210/117 |
| 2012/0015080 | A1 * | 1/2012 | Roulin et al. | 426/110 |
| 2012/0199227 | A1 * | 8/2012 | Manser et al. | 137/602 |
| 2014/0151324 | A1 * | 6/2014 | Limwanawong | 215/365 |
| 2014/0246122 | A1 * | 9/2014 | Epars et al. | 141/100 |
| 2014/0251147 | A1 * | 9/2014 | Epars et al. | 99/275 |
| 2014/0284298 | A1 * | 9/2014 | Epars et al. | 215/11.1 |

FOREIGN PATENT DOCUMENTS

| | | | |
|---|---|---|---|
| WO | 2008038054 | | 4/2008 |
| WO | WO 2008038054 | A2 * | 4/2008 |
| WO | 2008149087 | | 12/2008 |
| WO | WO 2008149087 | A2 * | 12/2008 |
| WO | WO 2009092629 | A1 * | 7/2009 |

* cited by examiner

EXPANDABLE CONTAINER FOR PREPARATION OF A NUTRITIONAL COMPOSITION

CROSS REFERENCE TO RELATED APPLICATIONS

The present application is a National Stage of International Application No. PCT/EP2012/070007, filed on Oct. 10, 2012, which claims priority to European Patent Application No. 11185431.1, filed Oct. 17, 2011, the entire contents of which are being incorporated herein by reference.

FIELD OF THE INVENTION

The present invention relates to a container of reduced volume for the preparation of a nutritional composition, especially an infant/toddler formula.

BACKGROUND OF THE INVENTION

Nutritional formulas or compositions can be, for instance, infant formulas or also nutritional liquids for toddlers, invalids, elderly people, humans having nutritional deficiencies and/or having a deficient immune system or athletes.

US2006226109A1 relates to a self-contained complete package of ready-to-use baby formula meals. The package comprises a combination of a reservoir, a coupling element; said reservoir comprising a flexible envelope of durable material operable for containing liquid for storage therein, and said coupling element comprising an integrated ergonomic interface formed of plastic and bonded with said reservoir to form a breakable airtight seal that prevents liquid contained in the reservoir from passing the seal until the seal is compromised to form a flow path from the reservoir to an exterior of the food package. Such package is thus designed for holding a ready-to-use baby formula in a sealed flexible reservoir. However, the problems of such package are related to the inconvenient of storing a ready-to-use composition such as a baby formula in the package such as the limited shelf-life of the composition, the hassle to manufacture, the impossibility to vary the dilution of the formula according to the baby's needs, the large reservoir needed for storing the full composition and so on.

In the field of nutritional compositions, preparation apparatuses are known, wherein a preferably powdered composition is provided within a capsule and is dissolved by means of injection of filtered respectively sanitized liquid such as water. Thereby, the nutritional compositions can be prepared on demand from such capsule in a matter of seconds. This solution also overcome the inconvenient of the ready-to-use compositions. The undesired contaminants can also be removed from the injected liquid before the liquid is mixed with the ingredients in the capsule. For this purpose, such apparatus preferably comprises filter means for filtering respectively sanitizing the water.

In recent development, capsules with integrated antimicrobial filter have been introduced into the market in order to ensure the provision of filtered respectively sanitized liquid to the capsule for the preparation of the nutritional composition.

WO2009/092629A1 for example relates to a capsule for use in a beverage production device, the capsule containing ingredients for producing a nutritional liquid when a liquid is fed into the capsule at an inlet face thereof, the capsule being provided with an anti-microbial filter.

WO2010/128051A1 relates to a capsule for preparing a nutritional product including a filter adapted for removing contaminants wherein the filter is formed of a filter unit that comprises a filter membrane and an outlet wall for supporting the filter membrane; the outlet wall comprising at least one liquid outlet communicating with the compartment.

A drawback with the known capsule-based preparation devices is the fact that in addition to the capsules containing the infant formula base, a serving vessel for the instant formula such as a baby bottle has to be provided. Accordingly, the required space for storage and transport of the components necessary for the preparation of the instant formula is relatively large.

Another drawback comes from the fact that the release of a reconstituted liquid composition from a capsule requires a complete dissolution or dispersion of the ingredients/formula with the diluents (e.g. ambient or warm water) and a complete release of the resulting composition from the capsule to the serving bottle.

Another drawback remains the requirement for cleaning and sterilizing serving vessel that is to be carried out after each and/or before each preparation of the nutritional composition.

Therefore, a more convenient solution is sought-after which overcomes these problems.

In particular, it is desirable to enable a facilitated storage and transport of the components of the beverage preparation system. It is also desirable to reduce the number of these components and their volume in order to reduce the environmental impact of the packaging.

It is also an object to remove the need for cleaning respectively sterilization of any major component.

The present invention seeks to address partially or wholly these objects. The invention may also aim at other objects and particularly the solution of other problems as will appear in the rest of the present description.

OBJECT AND SUMMARY OF THE INVENTION

In a first aspect, the present invention relates to a container for preparing of a nutritional composition from a powdered or concentrated liquid nutritional formula base, the container comprising:

- liquid inlet means comprising at least one conduit designed to be supplied with liquid from liquid dispensing means,
- an adaptor being provided with engagement means for connecting the container to matching engagement means of the liquid dispensing means, and
- a flexible wall portion, connected to the liquid inlet means and at least partially defining a compartment for containing a predefined amount of powdered or concentrated liquid nutritional formula base for the preparation of the nutritional composition upon hydration with the supplied liquid, wherein the flexible wall is expandable in a manner that the volume of the compartment increases from a retracted position to an expanded position allowing a sufficient volume of liquid to be supplied into the compartment through said liquid inlet means for the preparation of the nutritional composition.

Preferably, the flexible wall portion is expandable to provide an increase of at least 1.5 times, preferably at least 2 times, more preferably between 3 and 5 times the total volume of the compartment from its retracted position to its expanded position.

Preferably, the flexible wall portion designed to be both expandable and retractable in a stable retracted position so that the internal volume of the compartment can also be significantly reduced after use, i.e., after the removal of the nutritional composition.

It should be noted that the flexible wall is designed such that the volume of the compartment is increased, i.e., the flexible wall expands, before or during the supply of the gas or the liquid supplied in the compartment, preferably, by the liquid dispensing means. In a mode, the flexible wall expands by the pressure of liquid being supplied into the compartment through the inlet means. It should be noted that the expansion may result from the pressure of a gas or liquid being uniformly or punctually applied on the wall(s) of the container to provide expansion of the flexible wall. Additionally, the expansion may also result from additional factors such mechanical, fluidic and/or thermal. In particular, the expansion may also result from softening of the material of the flexible portion with liquid at ambient, warm of heated temperature. A gas may also be used to expand the compartment before liquid is supplied in the compartment. Such gas may be blown by gas dispensing means such as a compressed air pump.

According to the present invention, a container for preparing of a nutritional composition from an infant formula base is provided which may easily be stored and transported due to the reduced volume of the compartment in its retracted position.

The minimum volume in the retracted position of the compartment is preferably between 10 and 75 ml, more preferably between 15 and 50 ml, even more preferably between 20 and 40 ml.

The maximum volume in the expanded position of the compartment is preferably between 50 and 300 ml, preferably 70 to 260 ml, most preferably 90 to 200 ml.

The compartment is preferably made of thin-walled and lightweight packaging material. Preferably, the weight of the container without the nutritional composition may be between 5 and 10 grams. More preferably, the weight of the container is between 8 and 12 grams.

The compartment is preferably made of PET, PE, PP, PLA, a paper-plastic laminate, paper/plastic/aluminium laminate, starch-based material and combinations thereof. Thereby, the container is preferably made as an integral piece e.g. by means of blow-moulding or injection-moulding.

The compartment may be made of thin plastic preferably of a thickness lower than 150 microns, preferably between 130 and 40 microns, most preferably comprised between 45 and 100 microns The container according to the present invention is preferably a sealed container. Thereby, the term "sealed" means that the container is hermetically closed in such a manner that the ingress of liquid and contaminants, in particular, solid particles and micro-organisms, from the environment into the container is prevented. The "sealed" does not necessarily mean that the closure is impermeable to gas.

Accordingly, the container preferably comprises sealing means such as a sealing membrane and/or sealing cap that are arranged to cover the liquid inlet means of the container in order to prevent ingress of contaminants before use thereof.

The sealed container according to the invention preferably comprises a predefined amount of powdered or concentrated liquid nutritional formula base suitable for preparing the nutritional formula upon hydration with liquid.

In the following application, the simplified term "formula base" means a powdered or concentrated liquid nutritional formula base specifically designed for infants, toddlers, humans having nutritional deficiencies and/or having a deficient immune system, invalids, elderly people, or athletes; such formula base requiring a liquid, such as water, for the preparation of a ready-to-drink nutritional composition.

In a preferred embodiment, the container further comprises liquid outlet means that are designed to release gas and/or liquid from the compartment of the container to the exterior thereof. The liquid outlet means may for example be constituted by an aperture or opening in the compartment of the container. Alternatively, the liquid outlet means may be integrally formed with the liquid inlet means of the container, i.e. the liquid inlet means may also serve as liquid outlet means enabling the ejection respectively the dispensing of the prepared nutritional formula from the container.

The container preferably comprises a gas-liquid equilibrium means to allow gas, e.g., air or a protective gas contained in the compartment, to leave the compartment as liquid is fed thereto through the inlet means. In a mode, the gas-liquid equilibrium means may be a one-way valve which is permeable to gas but impermeable to liquid, thereby allowing the exit of gas from the interior of the compartment when water is fed thereto. Such gas-liquid equilibrium means may, for example, be constituted by a venting membrane connected or integrally formed with the compartment and/or inlet means to equalize the pressure within the compartment when liquid is provided thereto.

In a preferred embodiment, the liquid inlet means are designed to be connected by an external liquid probe of the liquid dispensing means. Accordingly, provided liquid such as preheated water can be directly fed to the inlet means and thus to the interior of a compartment in order to prepare the nutritional composition.

As already discussed, the flexible wall portion of the container may be designed to be inflatable. By "inflatable", it is meant that the flexible wall expands as a result of a fluid pressure injected into the compartment. The fluid may be gas, liquid or a combination of both. For instance, the volume of the compartment may automatically increase due to injection of liquid into the compartment for mixing with the ingredients during the preparation of the nutritional composition.

In a mode, the flexible wall is any one of or a combination of the following expandable structures:

- a concertina-type structure,
- a stepped structure,
- circumferential lines of weakness or of reduced thickness in the material itself.

More particularly, the flexible wall is any one of or a combination of the following expandable structures:

- a concertina-type structure wherein the concertina pleats are oriented transversally to the direction of the liquid inlet means,
- a stepped structure wherein the steps are oriented transversally to the direction of the liquid inlet means,
- circumferential lines of weakness or of reduced thickness wherein the lines are oriented transversally to the direction of the liquid inlet means.

The flexible wall portion may also be designed to enable manual squeezing of the container to force the nutritional composition out of the container after its preparation.

The flexible wall portion may as well be a folded pouch in the retracted position and be designed to unfold upon introduction of the fluid into the compartment. The flexible wall may be both unfoldable and inflatable.

According to another preferred mode, the flexible wall portion is a preform made of material designed to expand in contact with a heated liquid injected in the compartment. Such material may, for instance, be PLA, silicone or a starch-based material.

The flexible wall portion is preferably directly connected to the liquid inlet means. The flexible wall portion may as well be connected to the inlet means by means of an additional non-deformable wall portion constituting a neck portion of the container.

According to a preferred mode, the projected surface of the flexible wall portion in extended position constitutes at least 50%, preferably at least 75%, and more preferably at least 90% of the projected surface of the outer wall portion of the compartment.

Moreover, the flexible wall portion preferably constitutes a side portion of the compartment. The flexible wall may constitute a side portion and bottom portion of the compartment.

In another preferred mode, the flexible wall portion forms an expandable collar or tubular portion arranged between a non-deformable neck and non-deformable bottom portion of the container.

The compartment is preferably designed to expand in a predefined direction. Preferably, the compartment is designed to expand in a direction essentially oriented from the liquid inlet means towards the bottom of the container.

The container may comprise expansion guiding means which may be integrally formed with the compartment of the container. The expansion guiding means may be protrusions and/or recessions extending in longitudinal direction and/or lateral direction respectively about the circumference of the container.

The expansion guiding means may be constituted by portions of enlarged material thickness compared to the material thickness of the rest of the compartment respectively the flexible wall portion, thus providing a local restriction to the expansion of the compartment in predefined areas or sections thereof, which enables to define the expansion direction and amount of the compartment.

Alternatively, the expansion guiding means may be constituted by additional means at least partially encompassing the compartment. Thereby, the expansion guiding means are preferably in contact with the compartment in its retracted position or are brought into contact with the outer surface of the compartment during expansion thereof.

In a preferred embodiment, the liquid inlet means of the container are integrally formed with the adaptor. Thereby, the liquid inlet means and the adaptor are preferably designed to be more rigid than the flexible portion. As a result, the liquid inlet means and adaptor are non-deformable, e.g., upon provision of liquid under pressure thereto.

In a preferred mode, the container further comprises a filter assembly configured to remove contaminants from liquid fed into the compartment through the inlet means. Thereby, the filter assembly is preferably provided in the flow path of the liquid from the liquid inlet means to the compartment.

Moreover, the filter assembly is preferably removably arranged within the flow path from the inlet means to the compartment. Thereby, the container may comprise a disposable portion fixedly connected to at least the filter assembly and removably connected to the container.

The filter assembly comprises a filtering membrane and at least one rigid supporting wall downstream of the membrane. Preferably, the membrane is placed between a rigid upper (i.e. upstream) and lower (i.e. downstream) supporting wall. The membrane is preferably a micro-porous membrane such as described in WO 2009/092629. For antimicrobial purpose, the filter membrane has preferably a pore size of less than 0.4 microns, most preferably of less than 0.2 microns. It may have a thickness of less than 500 microns, preferably between 10 and 300 microns. The material of the membrane can be chosen from the list consisting of PES (polyethersulfone), cellulose acetate, cellulose nitrate, polyamide and combinations thereof. The membrane can be arranged to form a barrier to contaminants, in particular, microorganisms such as bacteria. Thereby, the outer wall of the filter assembly preferably comprises a liquid inlet and the inner wall comprises a liquid outlet to direct a liquid jet into the compartment. The liquid inlet of the filter assembly is preferably designed to be connected to an outlet probe of the liquid dispensing means in order to provide liquid to the filter assembly and thus, to the interior of the compartment.

The filter assembly is preferably lodged in a removable portion of the container such as a cap portion or the like. As a result, the filter assembly is removed before the nutritional composition is dispensed to the person, e.g., baby or toddler.

The filter assembly can be designed as a handleable rigid unit to withstand the pressure exerted thereon by liquid fed in the compartment and also to resist to manual mechanical constraints such as squeezing or piercing of the membrane by the outlet probe of the dispensing device. For example, the unit can be lodged in a dedicated recess provided in the removable portion of the container.

The filter assembly according to the present invention may be designed as the filter unit described e.g. in WO 2010/128051.

In another preferred embodiment of the present invention, the container further comprises feeding means such as a teat or nipple assembly. Thereby, the teat assembly may be provided as an additional part to the container which may be connected to the container by means of additional connection means. The teat assembly may be designed to match with correspondingly shaped connection means. The connection means may also be designed to fit a standard teat available on the market. Accordingly, the user may provide an external teat assembly to the container in order to facilitate feeding of the nutritional composition from the compartment to the consumer.

Preferably, the feeding means and removable cap portion are connected to each other in a sealed manner. For this, the removable cap portion sealingly covers the feeding means such that no dust or contaminant can contaminate the feeding means until the cap portion is effectively removed. A tamper evidence breakable closure means such as a breakable tab can be provided to the cap portion to provide a safety guarantee to the user.

The teat assembly is preferably confined in a retracted position in the adaptor such as by the disposable cap portion. The teat assembly then can be expanded after liquid has been supplied through the adaptor in the compartment and the cap portion is removed. Preferably comprises a flexible teat formed of moulded silicone, elastomer or, resilient and soft plastic.

The sealed container may comprise an integrally formed feeding means respectively a teat assembly which is arranged in fluid communication with the compartment. In such case, the feeding means is made non-removable from the compartment without destruction or deterioration of the container. As a result, the container cannot be re-used and it guarantees safety.

However, the integrally formed teat assembly can also be designed to be selectively removable from the container such as by providing removable connection means between the teat assembly and compartment. In such case, the teat assembly can be replaced by a new or sterilized one.

In a preferred embodiment, the container is designed to be connected to holding means or an external container designed to at least partially encompass the compartment of the container when being connected thereto. Thereby, the adaptor of the container is preferably designed for connecting the container to the external container or holding means.

The holding means respectively the external container may comprise expansion guiding means according to the invention. In particular, the external container may comprise an inner surface geometrically designed to at least partially restrict the expansion of the compartment during expansion from its restricted into its expanded state.

The holding means respectively the external container may as well enclose a volume which is larger than the compartment in its expanded position. Said holding means may be e.g. a baby bottle having connection means adapted to match with the correspondingly shaped adaptor.

The engagement means of the adaptor are preferably designed to match with an additionally provided connector e.g. for connecting the container to liquid dispensing means. The engagement means can be one or more portions of wall protruding transversally or being recessed from an outer surface of the container.

In another aspect, the present invention relates to a beverage production system, comprising a container as aforementioned, and a liquid dispensing means having engagement means of the liquid dispensing means for connecting to the engaging means of the adaptor of the container and outlet means for supplying liquid to the liquid inlet means of the container.

The system preferably further comprises an additionally provided connector for connecting the inlet means of the container to the outlet means of the liquid dispensing means.

Moreover, the system preferably further comprises an external container or holding means such as a baby bottle designed to be connected to the container.

BRIEF DESCRIPTION OF THE FIGURES

FIG. 5*a* is a sectional side view of the embodiment according to FIG. 4*c*, wherein the container is connected to an additional external container such as a baby bottle.

FIGS. 5*b* and 5*c* are sectional side views of the embodiment according to FIG. 6*a*, which relate to the container before and after provision of liquid into the compartment.

DETAILED DESCRIPTION OF EMBODIMENTS

Figure 1A:
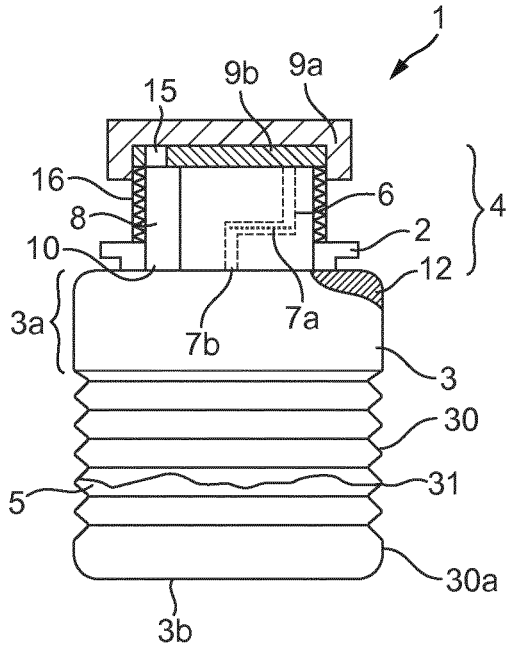
FIG. 1*a* is a schematic drawing of a preferred embodiment of the container, wherein the compartment comprises a concertina-type wall structure and is in its retracted position.

FIG. 1 shows a sectional side view of a preferred embodiment of the container 1 according to the present invention. The container 1 comprises a compartment 3 and an adaptor 4 connected or integral thereto.

The container further comprises liquid inlet means 6 which are arranged in an opening 10 of the container (or adaptor 4) and thus, in fluid connection with the compartment 3. The inlet means generally comprises a conduit allowing a fluidic engagement by an external liquid dispensing means.

Within the compartment 3 of the container 1*a* predefined amount of nutritional formula base 5 is preferably provided.

The adaptor 4 comprises engagement means 2 for connecting the container 1 to correspondingly shaped connection means 20*a* of a liquid dispensing means 20 (see FIG. 3) or an additionally provided connector 26 (see FIGS. 10*a*,10*b*). The engagement means 2 may be at least one protrusion and/or recession formed in the adaptor 4.

The container 1 may further comprise a filter assembly 7 that is associated to the inlet means 6 and connected to the container 1 preferably in a removable manner.

Thereby, the filter assembly 7 may be arranged within the opening 10 of the adaptor 4. As shown in FIG. 1*a*, the filter assembly 7 is arranged to at least partially close-off the opening 10.

In order to support the filter assembly 7 within the opening 10, a reinforcement structure 12 may be provided in the opening 10 and/or in a non-deformable neck portion 3*a* of the compartment 3 which is directly connected to the adaptor 4. The reinforcement structure 12 may be any structure integrally formed or provided within the adaptor 4 and/or the neck portion 3*a*.

The container 1 further comprises sealing means 9*a*, 9*b* which preventingress of the contaminants into the container 1 before use thereof. The sealing means preferably comprise an outer sealing membrane or cap 9*a* which is sealed to an outer surface of the adaptor 4 and/or the neck portion 3*a*. The outer sealing membrane or cap 9*a* is preferably designed to be removable by a user before use of the container 1. Instead of the outer sealing membrane 9*a*, the container 1 may be provided in a sealing enclosure such as a removable sealing packaging.

The sealing means may also comprise an inner sealing membrane 9*b* constituting a disposable portion that is at least partially fixedly connected to the filter assembly 7.

Figure 2:
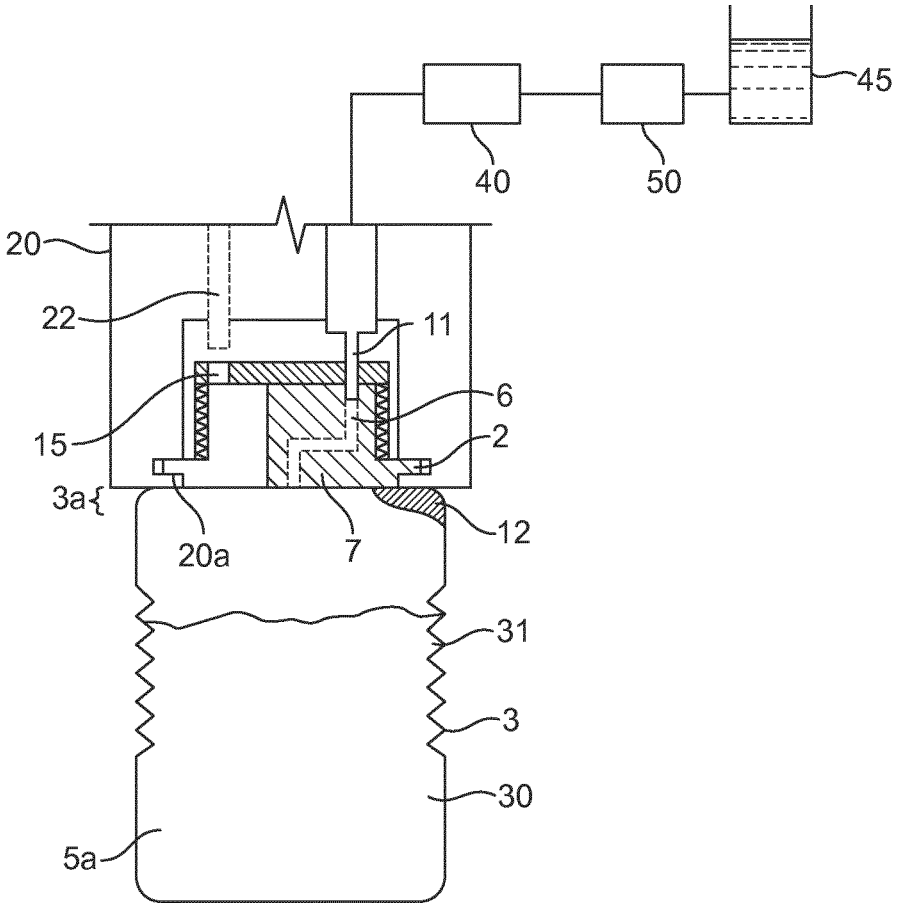
FIG. 2 is a schematic drawing of a system according to the present invention, wherein the container is connected to a liquid dispensing means.

The filter assembly 7 is in connection with or comprises the liquid inlet 6 suitable for being connected by a specifically designed liquid probe 11 of a dedicated liquid dispensing means 20 (see FIG. 2).

The filter assembly 7 further comprises a filter membrane 7*a* and a liquid outlet 7*b* which connects the inlet 6 to the opening 10 respectively the compartment 3 of the container 1.

The container 1 further comprises outlet means 8 which enable the ejection of liquid and/or air from the compartment 3. The outlet means 8 may be constituted by at least a portion of the opening 10.

The inner sealing means respectively sealing membrane 9*b* preferably comprises a gas-liquid equilibrium means such as a venting opening 15 which allows the venting of the compartment 3 after the outer sealing means 9*a* have been removed from the container 1. Such opening could be replaced by a valve or an equivalent.

The compartment 3 of the container 1 is at least partially constituted by a flexible wall portion 31. The expandable portion 31 is preferably integrally formed with the outer wall 30 of the compartment 3 and has a plurality of recesses and/or protrusions arranged about the circumference of the compartment 3 thus forming a concertina-type wall structure.

The compartment 3 preferably comprises a bottom portion 3*b*. Said bottom portion 3*b* is preferably non-deformable upon liquid injection into the container 1. Accordingly, the flexible wall portion 31 forms an expandable collar arranged between the preferably non-deformable neck portion 3*a* and said bottom portion 3*b*. It is to be noted however that the bottom portion 3*b* of the compartment 3 may as well be at least partially constituted by a flexible wall portion 31 according to the present invention.

As shown in FIG. 1*a*, the container 1 is in its retracted position before being used. Thereby, the concertina-type portion 31 of the outer wall 30 is folded together in order to occupy a minimum storing space, but at the same time provide a sufficient volume for a pre-metered amount of the powdered or concentrated nutritional formula base 5 within compartment 3 of the container 1.

Figure 1B:
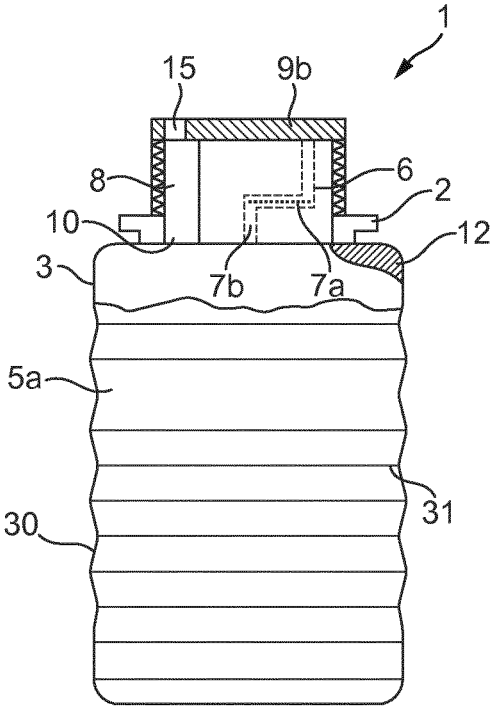
FIG. 1*b* is a schematic drawing of the container according to FIG. 1*a*, wherein the compartment is in its expanded position.

The concertina-type portion 31 of the container 1 may then be expanded as shown in FIG. 1*b* either manually and/or by the liquid filling the container 1 during liquid provision thereto. Hence, a sufficient volume for containing the hydrated nutritional composition 5*a* is provided within the compartment 3.

In the expanded position of the compartment 3, the expandable portion 31 preferably enables a manual squeezing of the compartment 3 in order to force the nutritional composition 5*a* out of the container 1 after its preparation.

After use of the container 1, the expandable portion 31 may be retracted manually to a reduced volume of the compartment. The container thus occupies a minimum storage space after use.

In another possible mode, the compartment 3 is already in its expanded position before liquid provision to the container 1. For instance, the compartment is expanded manually or mechanically. Then, after use of the container 1, the user may reduce the volume of the compartment 3 by retracting the portion 31 such by applying compressive forces on the neck and bottom sides.

It is to be noted that the expandable portion 31 may as well comprise a stepped structure, circumferential lines of weakness or a reduced thickness in the material of the outer wall 30 of the compartment 3.

FIG. 2 shows a schematic drawing of the system according to the present invention comprising liquid dispensing means 20 and a container 1. The liquid dispensing means 20 preferably comprise a water reservoir 45, a pump 40 and a heater 50 suitable for heating the liquid provided by means of the liquid supply in a continuous flow.

The liquid dispensing means 20 preferably further comprise engaging means 20*a* designed for connecting the engagement means 2 of the adaptor 4. Moreover, the liquid dispensing means 20 comprise an outlet probe 11 which is designed to connect to the inlet 6 of the filter assembly 7 of the container 1.

In addition, the liquid dispensing means 20 may further comprise opening means 22 which are designed to tear or perforate the membrane 9*a*. Thereby, the opening means 22 may be arranged to open the membrane 9*a* in order to allow venting of the compartment 3 during liquid injection thereof. Moreover, the opening means 22 may be integrally formed with the outlet probe 11. The outlet probe 11 and/or the opening means 22 are preferably movable relative to the connection means 20*a* of the dispensing means 20.

After opening of the membrane 9*a* by means of the outlet probe 11 and/or the opening means 22, liquid may be injected into the container 1, thus expanding the compartment 3 from its retracted state into its expanded state. Thereby, a user may control the amount of liquid provided into the compartment 3 e.g. by means of a dedicated control means (not shown) connected at least to the pump 40 of the water dispensing means 20.

Figure 3C:
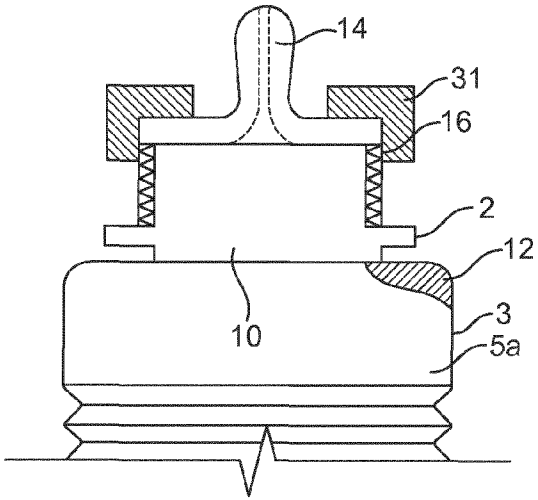
FIG. 3*c* is a schematic drawing of the embodiment according to FIGS. 3*a* and 4*b*, wherein an additionally provided teat assembly has been attached onto the container.
Figure 3B:
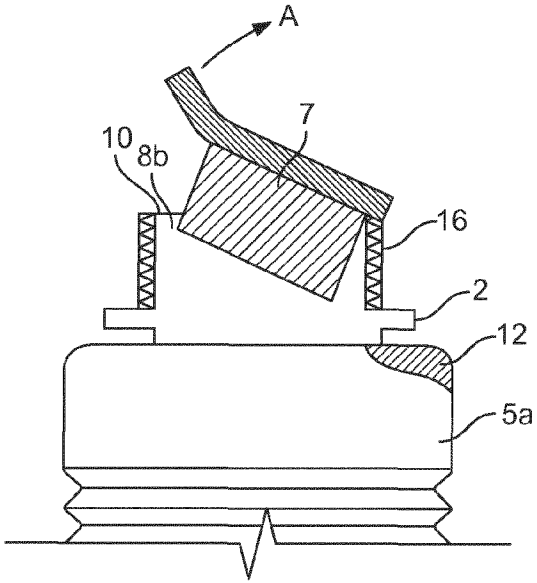
FIG. 3*b* is a schematic drawing of the embodiment according to FIG. 3*a*, wherein the filter assembly is removed.
Figure 3A:
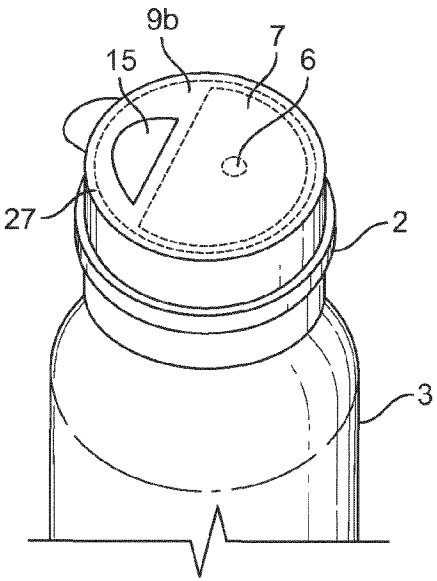
FIG. 3*a* is a schematic drawing showing a perspective top view of the embodiment according to FIG. 1*a* in which the outer membrane has been removed from the container.

FIG. 3*a* relates to the container 1 being at least partially opened by means of removing the first membrane or cap 9*a* sealed to an outer portion of the second sealing membrane 9*b* and/or to the adaptor 4. Thereby, an outlet aperture 15 or valve which is preferably provided within the membrane 9*b* is laid open. The liquid inlet 6 is preferably still covered by the inner membrane 9*b* and is opened upon contact with the outlet probe 11 of the dispensing means 20.

After the injection of liquid into the compartment 3 by means of the outlet probe 11 being connected to the filter assembly 7, the filter assembly 7 may be removed from the container 1 by tearing the second membrane 9*b* as shown in FIG. 3*b* (see arrow A). Thereby, the sealing between the second membrane 9*b* and an outer circumferential portion 27 of the adaptor 4 is weaker than the sealing connection between the second sealing membrane 9*b* and the filter assembly 7.

By means of the removing the filter assembly 7, a liquid outlet 8*b* of increased cross-sectional area is provided which enables to facilitate the removal of the complete liquid nutritional composition 5*a* from the now expanded compartment 3.

Before the withdrawal of the nutritional composition 5*a*, a feeding means such as a nipple or teat assembly 14 may be provided to the container 1. As can be seen in FIG. 3*c*, the teat assembly 4 may be connected for example by means of a dedicated connection means such as a cap nut 31 which interacts with the provided screw thread 16 at the circumference of the adaptor 4. Thereby, the teat assembly 14 is preferably a standard teat assembly available on the market.

The teat assembly 14 may as well be specifically designed in order to match a correspondingly shaped connection means 16. In particular, the teat assembly 14 may comprise a protruding connection skirt of varying geometrical form, such as e.g. oval-shaped, and which may be connected onto the correspondingly shaped connection means.

Figure 4A:
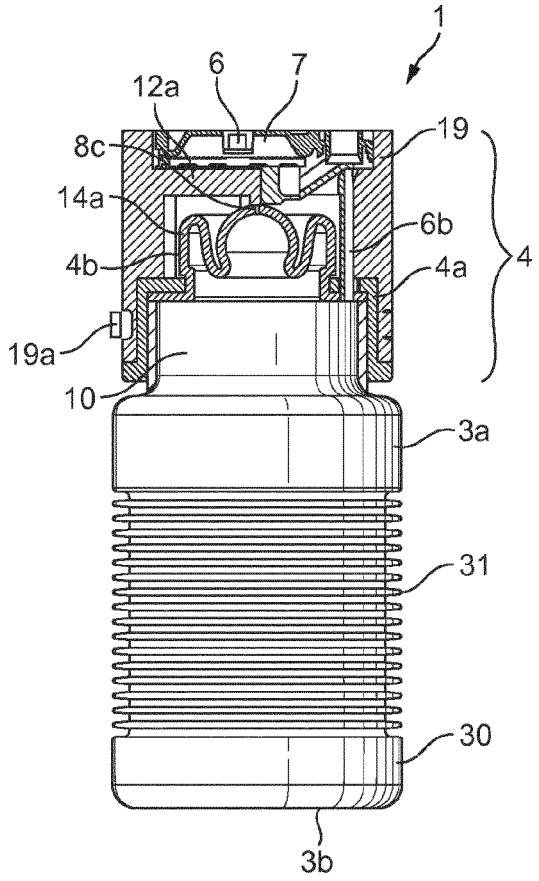
FIG. 4*a* is a sectional side view of another preferred embodiment of the container, wherein the container comprises an integrally formed teat assembly.

FIG. 4*a* relates to another preferred embodiment of the container 1, wherein a feeding means 14*a* is part of the container. Thereby, the adaptor 4 comprises a disposable cap portion 19 which is preferably a sealing collar removably connected to an annular portion 4*a* of the adaptor 4. Said annular portion 4*a* is in turn connected to a non-deformable neck portion 3*a* of the container 3. The disposable portion 19 is preferably secured to the annular portion 4*a*, e.g. by means of a tamper evidence latch member 19*a*.

The filter assembly 7 is preferably fixedly connected to the disposable cap portion 19 which holds the filter assembly 7 in position above the integrally formed feeding means 14*a* by means of integrally formed holding structure 12*a*. In particular, the portion 19 comprises a recess, with the holding structure 12*a* constituting the bottom holding part, for receiving the filter assembly 7 therein.

The feeding means 14*a* is preferably a teat assembly connected to an inner surface 4*b* of the annular portion 4*a*, thereby preferably fully closing-off the opening 10 of the adaptor 4. The feeding means 14*a* is preferably in a compressed respectively retracted state when the disposable portion 19 is connected to the annular portion 4*a*.

The feeding means 14*a* preferably constitute the outlet means of the container 1. Thereby, the feeding means 14*a* comprise an outlet 8*c* providing an additional outlet flow path from the compartment 3 to the exterior of the container 1 when liquid is dispensed from the compartment 3. The outlet 8*c* preferably also serves as a venting means in order to enable gas provided within the compartment 3 to exit the compartment 3 during provision of liquid thereto.

The flow path from the inlet means 6 to the compartment 3 is preferably arranged in parallel to the additional outlet flow path between the compartment 3 and the outlet 8*c*. Thereby, the disposable portion 19 preferably comprises an integrally formed liquid channel 6*b* which is connected to the filter assembly 7 and the compartment 3 in order to constitute an inlet flow path for feeding liquid to the compartment 3. The channel 6*b* is configured to provide a jet of liquid in the compartment so that a mixture of the liquid with the nutritional formula base is promoted. For instance, the entry or exit of the channel comprises a tiny hole.

The container 1 of FIG. 4*a* can form a fully sealed container containing a predefined amount of powdered or concentrated liquid nutritional formula base. For this, a perforable or removable sealing membrane covers the filter assembly and liquid inlet 6. After removal or perforation of the sealing membrane, the container is filled with liquid supplied by external liquid dispensing means. Liquid entering the liquid inlet 6 is filtered through the filter assembly 7 so that the undesired contaminants are removed before reaching the liquid channel 6*b* and being dispensed in the product compartment 3. After thorough mixture of the liquid with the nutritional formula base, the cap portion 19 can be removed causing the removal of the filter assembly and the deployment of the teat assembly. Before removing the cap portion, the thorough mixture can be completed by manually shaking the container if necessary. The presence of the cap portion prevents liquid from splashing during shaking. After removal of the cap portion, the nutritional composition is ready to be served. After feeding to the person with the nutritional composition, the feeding container can be discarded.

Figure 4B:
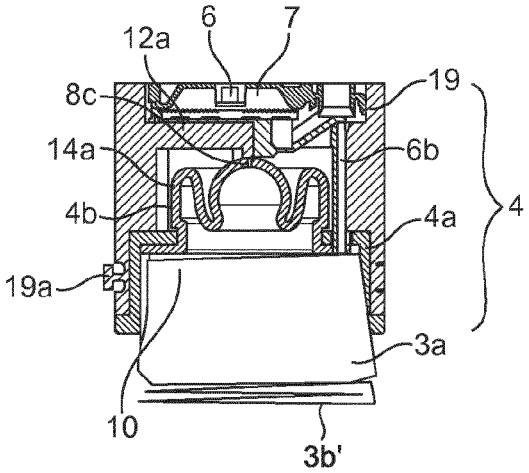
FIG. 4*b* is a sectional side view of the embodiment according to FIG. 4*a*, wherein the compartment is formed by an unfoldable pouch or bag.

FIG. 4*b* relates to the container 1 according to FIG. 4*a*, wherein the flexible portion 3*b*' of the compartment 3 is constituted by an unfoldable portion of pouch or bag. Thereby, the compartment preferably comprises at least an unfoldable bottom portion 3*b*' which is designed to be unfolded upon provision of liquid thereto. The compartment further comprises a non-unfoldable portion 3*a* enabling a proper connection to the annular portion 4*a* of the adaptor 4.

Figure 4C:
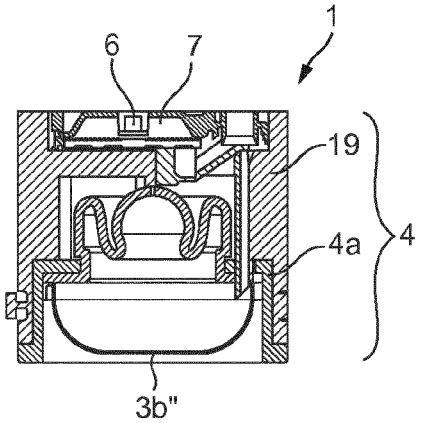
FIG. 4*c* is a sectional side view of the embodiment according to FIG. 4*a*, wherein the compartment is an inflatable bag.

FIG. 4*c* relates to the container 1 according to FIGS. 4*a* and 4*b*, wherein the flexible wall portion 3*b*" forming the compartment 3 is an inflatable bag. The inflatable bag 3*b*" which is shown in its retracted state is preferably fixedly connected to the annular portion 4*a* of the adaptor 4 by means of pinching, a common glue, welding technique or combination thereof. The bag may be formed of a thin polymeric stretchable material such as silicone and the like. The bag behaves as a bladder when liquid is injected therein. Of course, the flexible wall portion 3*b*" could only partially form the compartment such as its sidewall, the rest of the compartment, for example its bottom, forming a non-deformable portion.

Of course, the adaptor 4 and filter assembly 7 can be of same type for all embodiments of FIGS. 4*a* to 4*c*.

Figure 5A:
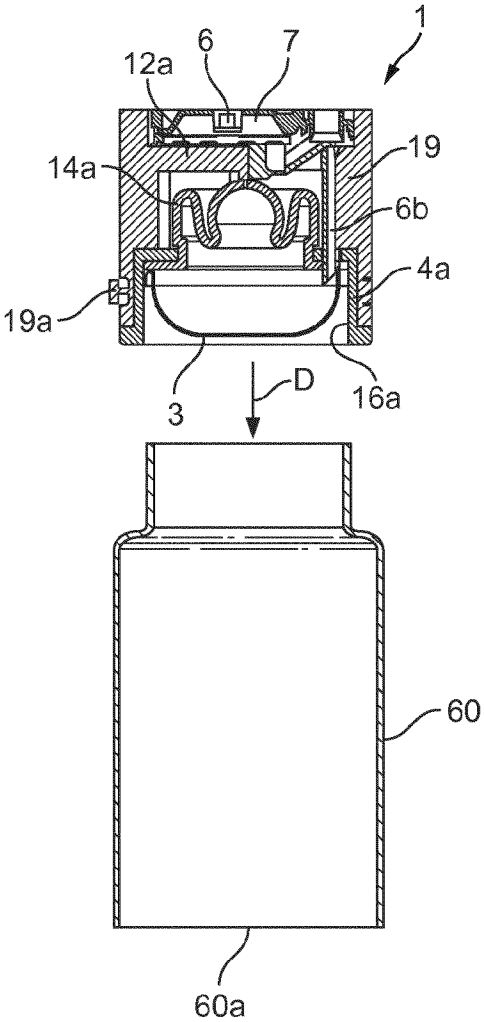
FIGS. 5*a* to 5*c* are perspective side views relating to the embodiment according to FIG. 6*a* before use, after removal of the disposable portion and after expansion of the integrally formed teat assembly.
Figure 5B:
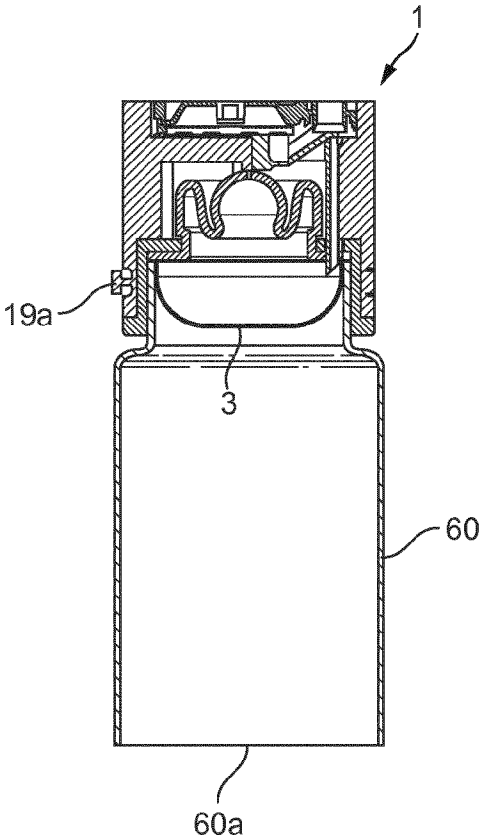

As shown in FIG. 5*a*, the annular portion 4*a* of the adaptor 4 preferably further comprises a connection means 16*a* which may be arranged on an inner or outer annular surface of the annular portion 4*a* and which are designed in order to connect the container 1 to an outer holding means or rigid container 60 (see arrow D) such as e.g. a plastic baby bottle. Thereby, the volume of the holding means or container 60 is preferably large enough to encompass the compartment 3 of the container 1 in its expanded position. The function of the holding means or outer container 60 is mainly to provide sufficient handling to the user or baby. Preferably an air gap is provided between the compartment 6 and the container to provide thermal insulation and therefore prevent a too rapid temperature loss of the liquid container in the container 1.

The size and geometric form of the additional container 60 may be designed in order to not directly contact an outer surface of the extended compartment 3. Hence, the transmission of heat from the inside of the compartment 3 to the container 60 is effectively prevented by means of air present between container 60 and compartment 3. As a result, the proper temperature of the nutritional composition in the compartment 3 when filled, is prevented from dropping too rapidly. The container 60 also preferably comprises an air venting means such as e.g. a valve or a bottom opening 60*a* in order to enable the compartment 3 to expand within the container 60.

Figure 5C:
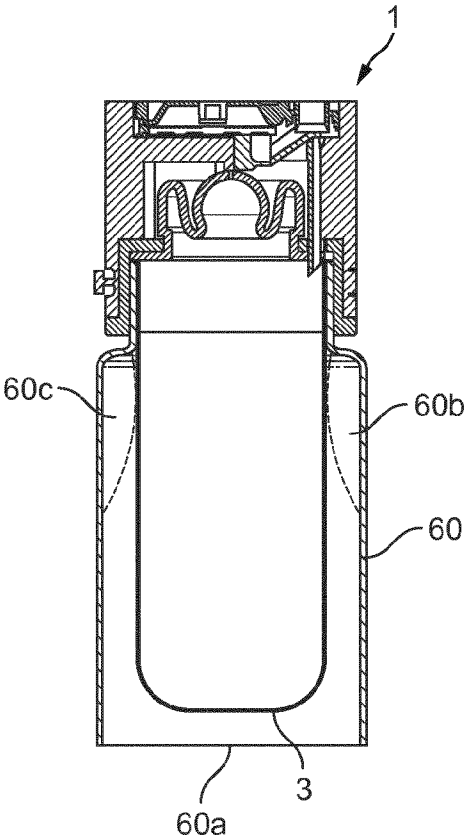

The container 60 may as well comprise expansion guiding means designed to at least partially restrict the expansion of the compartment 3 in order to force the compartment 3 to expand in privileged directions. The expansion guiding means may for example be an inner surface 60*b* designed to interact with the expanded compartment 3 in order to provide a desired form of the compartment 3 within the container 60. Accordingly, the inner surface 60*b* may for example comprise protrusions and/or recessions 60*c* to which the expandable compartment 3 may abut when liquid is provided therein, thus providing a compartment 3 of specific shape (see FIG. 5*c*). Accordingly, for example removal of the liquid from the compartment 3 may be enhanced.

Figure 6C:
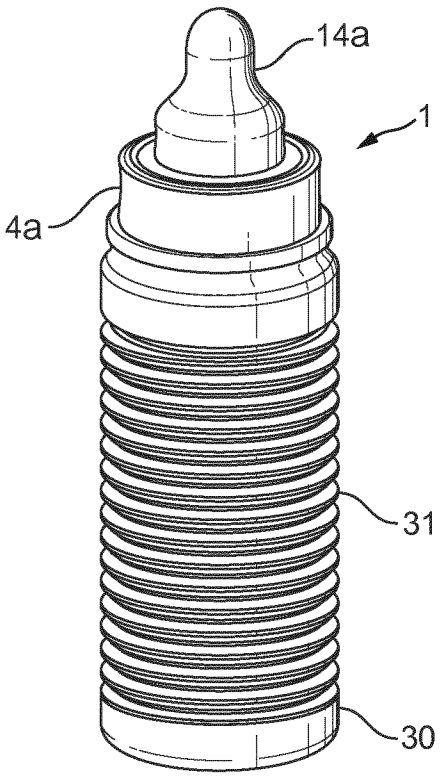
FIGS. 6*a* to 6*c* are respective perspective views of the embodiment of FIG. 6*a*, which relate to the bottle in retracted position and expanded position respectively.
Figure 6B:
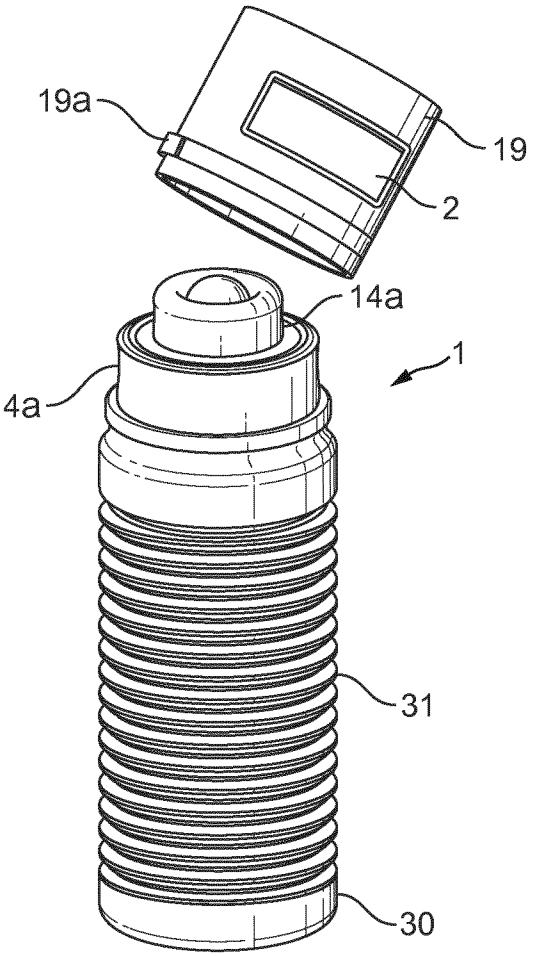
Figure 6A:
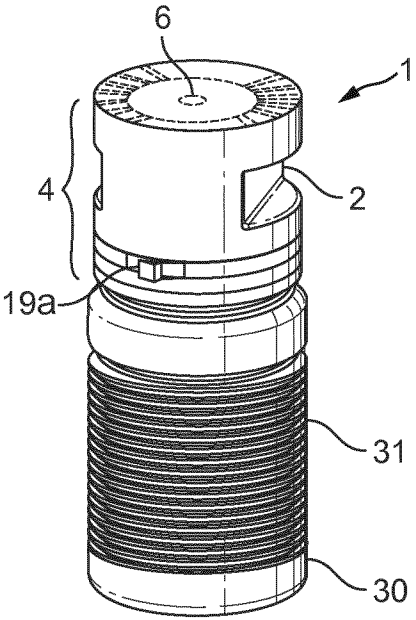

FIGS. 6*a* to 6*c* relate to the embodiment of the container 1 according to FIG. 4*a*. As shown in FIG. 6*a*, the container 1 may be stored in its retracted position. Thereby, the flexible wall portion 31 of the outer wall 30 is folded together in order to occupy a minimum storing space, but at the same time provide a sufficient volume for housing the predefined amount of infant formula base 5. The concertina-type portion 31 of the container 1 may then be expanded as shown in FIG. 8*b* either manually and/or by the liquid filling the container 1 during liquid provision thereto.

After provision of liquid into the container 1, the disposable portion 19 of the adaptor 4 is removed from the annular portion 4*a* by pulling the securing latch member 19*a*. The teat assembly 14*a* that is preferably arranged within the container 1 in a retracted position may then be brought into an expanded state manually, e.g. by squeezing the container 1 (see FIG. 6*c*).

Figure 7A:
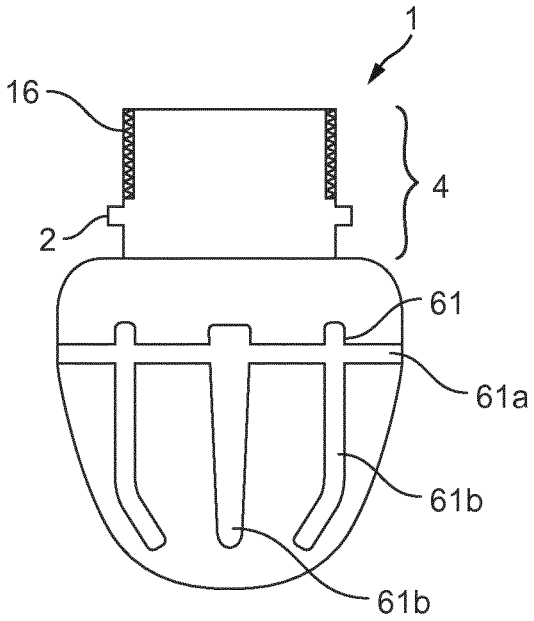
FIG. 7*a* is a side view of another embodiment of the container, wherein the compartment comprises integrally formed expansion guiding means and is in its retracted position.

FIG. 7*a* relates to another preferred embodiment of the container 1, wherein the expandable compartment 3 comprises integrally formed expansion guiding means 61. Thereby, the expansion guiding means 61 are protrusions and/or recessions preferably integrally formed in the flexible wall portion 31 and designed to at least locally restrict the expansion of the container 3.

Figure 7B:
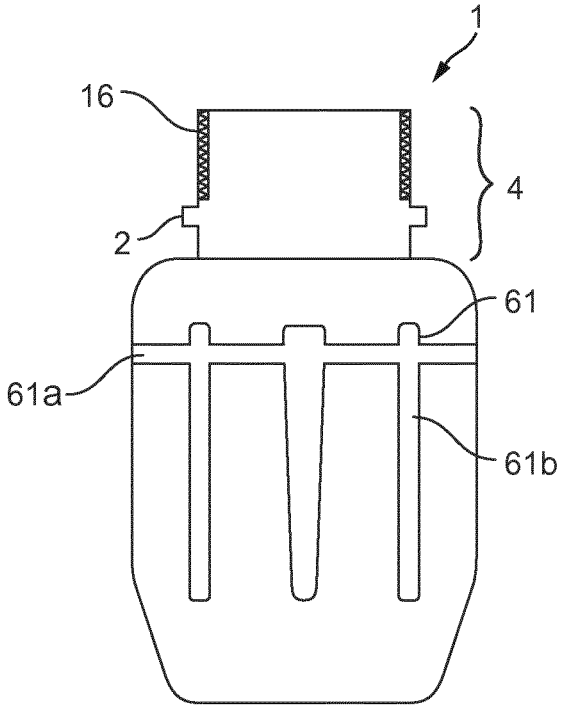
FIG. 7*b* is side view of the embodiment according to FIG. 8*a*, wherein the compartment is in its expanded position.

The expansion guiding means 61 may comprise circumferential guiding means 61*a* which are arranged essentially in a lateral respectively annular direction of the compartment 3. In particular, the circumferential guiding means 61*a* may be annular ring portions encompassing the compartment 3 and thus restricting the radial expansion of the compartment (see FIG. 7*b*).

The expansion guiding means 61 may as well comprise axial respectively longitudinal guiding means 61*b* which extend in an axial direction of the container 1. Thereby, the axial guiding means 61*b* may be for example of parallel and/or triangular form, thereby at least partially restricting an axial expansion of the compartment.

Figure 8A:
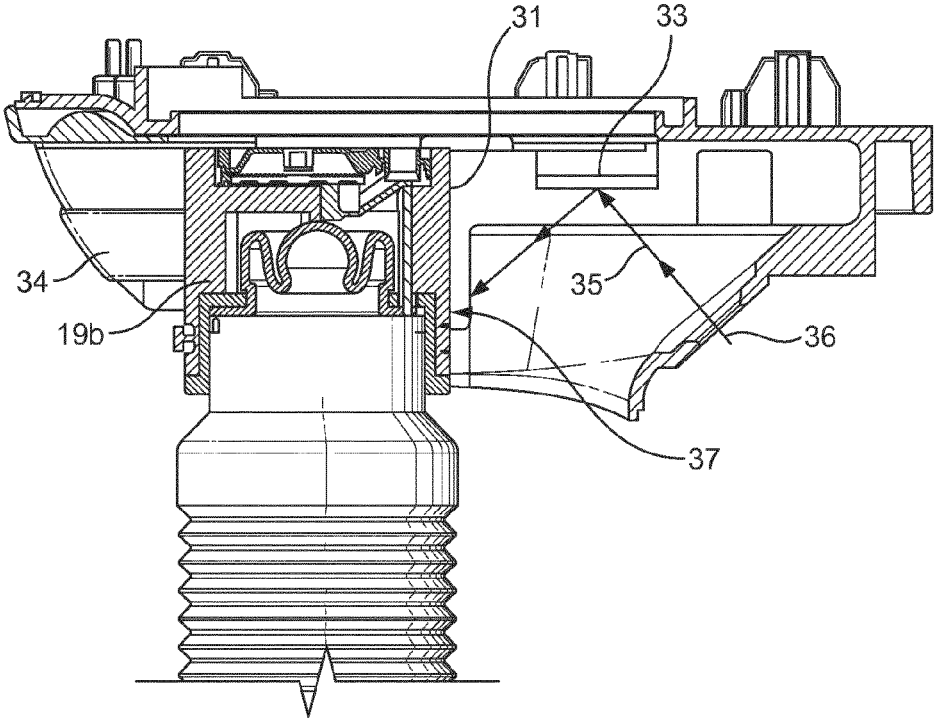
FIG. 8*a* is a sectional side view of the embodiment according to FIG. 4*a*, wherein the container is connected to connector of the system.
Figure 8B:
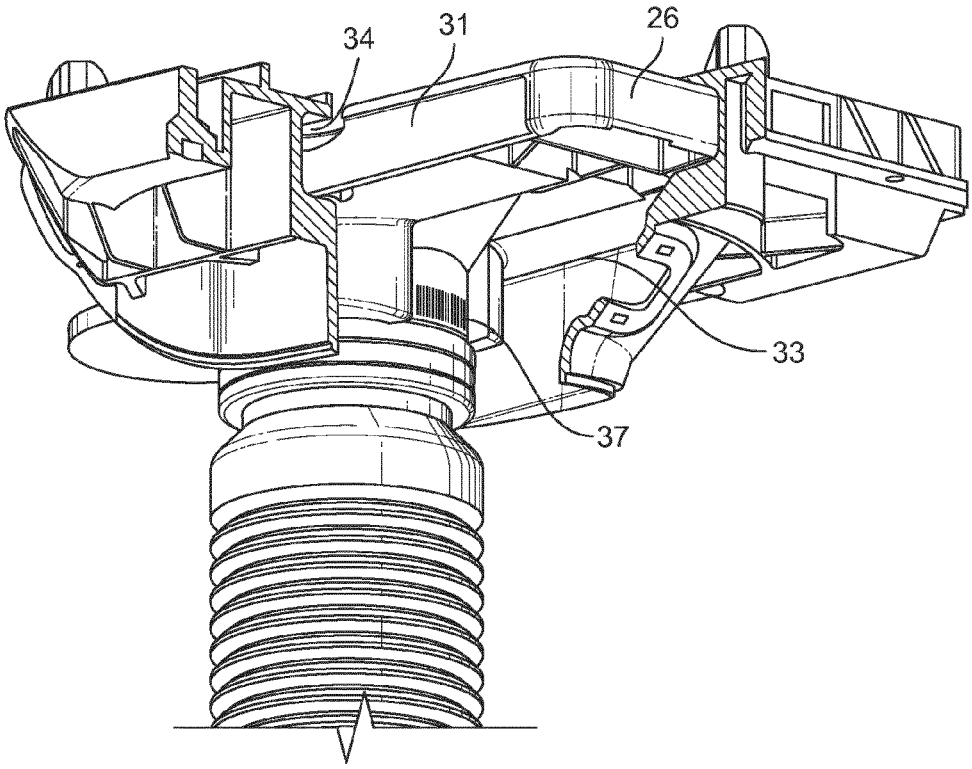
FIG. 8*b* is a perspective sectional side view of the embodiment according to FIG. 8*a*.
Figure 9A:
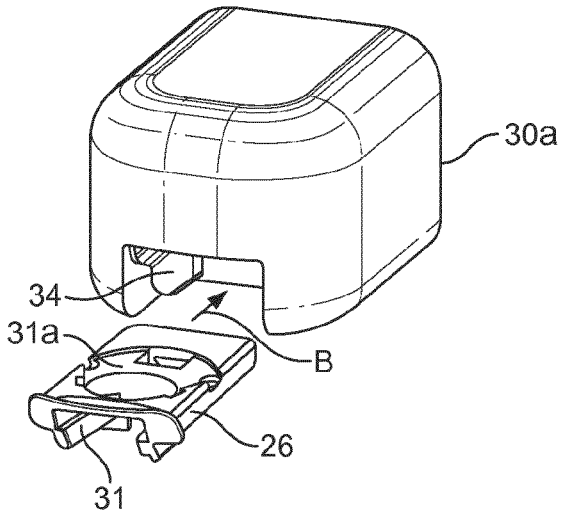
FIG. 9*a* is a perspective side view of an injection head of dispensing means and a connector.
Figure 9B:
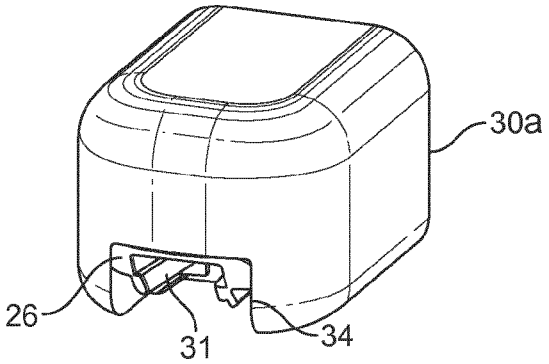
FIG. 9*b* relates to the embodiment according to FIG. 8*a*, wherein the connector is inserted into the injection head.
Figure 9C:
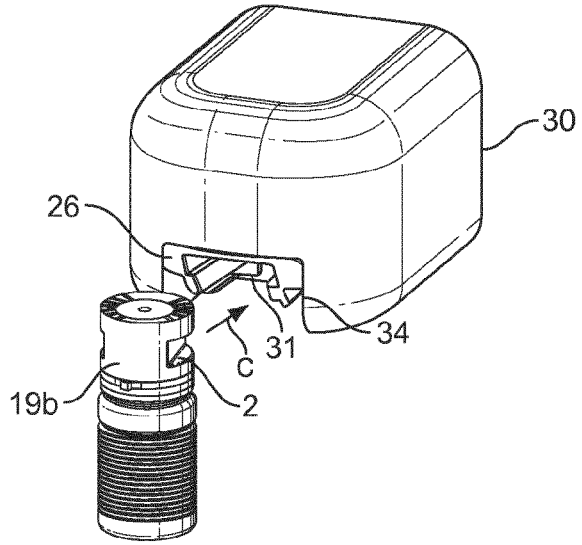
FIG. 9*c* shows the embodiment according to FIG. 8*a* being inserted into the injection head by means of the connector.

FIGS. 8*a* and 8*b* show the embodiment of the container 1 according to FIG. 4*a*, wherein the container 1 is connected to an additional connector 26 also possibly called "container holder" that is designed for connecting the container 1 to the dispensing means 20 and in particular to a dispensing head 30*a* of the dispensing means 20 as also shown in FIGS. 9*a*-9*c*.

The connector or container holder 26 preferably comprises a connecting portion 31 that connects to the engagement means 2 of the adaptor 4. Thereby, the connecting portion 31 may be at least one guiding rail which interacts with the recessed or protruding engagement means 2 (see FIG. 9*c*, arrow C).

The connecting portion 31 may as well be designed as a snap-fit connection connecting to the engagement means 2 upon insertion of the container 1 and/or turning of the container 1 about a vertical axis thereof.

The connector 26 is preferably designed to be selectively connected to a receiving recess 34 of the dispensing head 30*a* (see FIGS. 9*a* and 9*b*, arrow B). Thereby, the connector 26 may as well comprise an aperture 31*a* for holding a capsule or cartridge containing a predefined amount of infant formula base, which is designed to receive the capsule when inserted from above in said aperture 31*a* (see FIG. 9*a*-9*c*).

The connector 26 preferably comprises integrally formed interface means 33 which are arranged to provide a signal transfer from the dispensing means 20, to which the connector 26 is intended to be connected, to the container 1 or vice versa. Thereby, the interface means 33 may be any means enabling the transfer of an optical, electrical and/or acoustical signal between the dispensing means and the container 1.

Preferably, the interface means 33 is a mirror arranged at the connector 26 such as to transfer or redirect a signal 35 from the dispensing means 20 towards an outer portion of the container 1. Thereby, the signal may be e.g. an optical signal 35 from a barcode reader 36 that is transferred by the interface means 33 of the connector 26 to a peripheral outer surface 19*b* of the disposable portion 19 onto which a barcode 37 may be provided.

It is to be understood that by means of the signal transferred from the container 1 to the dispensing means 20 or vice versa, a dedicated control unit (not shown) of the dispensing means 20 may adjust injection parameters such as the amount of the liquid to be injected into the compartment 3 of the container 1 and/or the temperature of liquid or its flow rate.

Although the present invention has been described with reference to preferred embodiments thereof, many modifications and alternations may be made by a person having ordinary skill in the art without departing from the scope of this invention which is defined by the appended claims.

The invention claimed is:

1. A container for preparing of a nutritional composition from a powdered or concentrated liquid nutritional formula base upon hydration with supplied liquid, the container comprising:

an adaptor comprising a liquid inlet positioned therewithin, an engagement member for connecting the container to a matching engagement member of a liquid dispenser, and an inner membrane that covers the liquid inlet, the inner membrane comprising an outlet aperture in a different portion of the inner membrane relative to where the liquid inlet intersects the inner membrane; and a compartment for containing a predefined amount of powdered or concentrated liquid nutritional formula base for the preparation of the nutritional composition upon hydration with the supplied liquid, the compartment comprising a flexible wall portion and a non-deformable neck portion with an opening connected to the adaptor;

the flexible wall portion being expandable in a manner that the volume of the compartment increases from a retracted position to an expanded position allowing a sufficient volume of liquid to be supplied into the compartment through the liquid inlet for the preparation of the nutritional composition;

wherein the liquid inlet communicates with the opening of the compartment and comprises at least one conduit to be supplied with liquid from the liquid dispenser, and the adaptor further comprises a liquid outlet communicating with the opening of the compartment at a different location relative to the liquid inlet and which is configured to release liquid from the compartment of the container to the exterior thereof.

2. The container according to claim 1, wherein the flexible portion is expandable due to liquid being supplied in the compartment.

3. The container according to claim 1, wherein the container is a sealed container and wherein the compartment contains a predefined amount of the powdered or concentrated liquid nutritional formula base.

4. The container according to claim 1, wherein the container comprises an additional connection designed for connecting a feeding member to the container.

5. The container according to claim 1, wherein the container comprises a feeding member.

6. The container according to claim 1, wherein the flexible wall portion is designed to be expanded and then retracted from the expanded position to a retracted position.

7. The container according to claim 1, wherein the flexible wall portion is an expandable structure selected from the group consisting of:

(i) a concertina-type structure;

(ii) a stepped structure;

(iii) circumferential lines of weakness or of reduced thickness in the material itself; and (iv) combinations thereof.

8. The container according to claim 1, wherein the flexible wall portion forms a folded portion of bag designed to unfold upon introduction of liquid into the compartment.

9. The container according to claim 1, wherein the wall portion forms an inflatable bag made of a material designed to expand due to a heated liquid.

10. The container according to claim 1, wherein the flexible wall portion is expandable to provide an increase of at least 1.5 times the total volume of the compartment from the retracted position to the expanded position.

11. The container according to claim 1, wherein the liquid inlet of the container is integrally formed with the adaptor.

12. The container according to claim 1, wherein the liquid inlet comprises a filter assembly configured to remove contaminants from liquid fed into the compartment through the inlet.

13. The container according to claim 1, wherein the adaptor of the container has a connection member adapted for connecting the container to an outer rigid container or holder which at least partially surrounds the compartment.

14. The container according to claim 1, wherein the container comprises a gas-liquid equilibrium member to allow gas to leave the compartment as liquid is fed thereto.

15. A beverage production system comprising:

a container for preparing of a nutritional composition from a powdered or concentrated liquid nutritional formula base upon hydration with supplied liquid, the container comprising:

an adaptor comprising a liquid inlet positioned therewithin, an engagement member for connecting the container to a matching engagement member of a liquid dispenser, and an inner membrane that covers the liquid inlet, the inner membrane comprising an outlet aperture in a different portion of the inner membrane relative to where the liquid inlet intersects the inner membrane, and a compartment for containing a predefined amount of the powdered or concentrated liquid nutritional formula base for the preparation of the nutritional composition upon hydration with the supplied liquid, the compartment comprising a flexible wall portion and a non-deformable neck portion with an opening connected to the adaptor, and the flexible wall portion being expandable in a manner that the volume of the compartment increases from a retracted position to an expanded position allowing a sufficient volume of liquid to be supplied into the compartment through the liquid inlet for the preparation of the nutritional composition; and a liquid dispenser having an engagement member for connecting to the engaging member of the adaptor of the container and an outlet for supplying liquid to the liquid inlet of the container, wherein the liquid inlet communicates with the opening of the compartment and comprises at least one conduit to be supplied with liquid from the liquid dispenser, and the adaptor further comprises a liquid outlet communicating with the opening of the compartment at a different location relative to the liquid inlet and which is configured to release liquid from the compartment of the container to the exterior thereof.

16. The beverage production system according to claim 15, wherein the engagement member of the liquid dispenser comprises a guiding rail which interacts with a recessed or protruding portion of the engaging member of the adaptor.

* * * * *